US005325629A

United States Patent [19]

Hsu

[11] Patent Number: 5,325,629

[45] Date of Patent: Jul. 5, 1994

[54] GRATINGS FOR WINDOWS/DOORS

[76] Inventor: Chi-Lu Hsu, No. 9, Lane 76, An-Kung Rd., Sec. 1, Hsin-Den, Taiwan

[21] Appl. No.: 62,609

[22] Filed: May 18, 1993

[51] Int. Cl.[5] ..... E06B 3/68
[52] U.S. Cl. ..... 49/50; 52/668
[58] Field of Search ..... 49/50; 52/668, 669, 52/666, 664

[56] References Cited

U.S. PATENT DOCUMENTS

| | | | |
|---|---|---|---|
| 1,445,401 | 2/1923 | Lachman | 53/668 |
| 4,145,858 | 3/1979 | Dovman | 52/668 X |
| 4,452,025 | 6/1984 | Lew | 52/668 |
| 5,018,332 | 5/1991 | Ying-Kit | 52/668 X |

FOREIGN PATENT DOCUMENTS

| | | | |
|---|---|---|---|
| 618783 | 3/1961 | Italy | 52/668 |

*Primary Examiner*—Philip C. Kannan
*Attorney, Agent, or Firm*—Browdy and Neimark

[57] ABSTRACT

Gratings for windows/doors, and more particularly window/door gratings which are structured with a plurality of integrally formed top members and a plurality of integrally formed bottom members. The top members each has a plurality of lower notches or cuts which can engage with corresponding upper notches or cuts on the bottom members and thereby enable the top members to easily, quickly, and firmly intersect with the bottom members to provide different patterns. The sections on the top and the bottom members between two notches or cuts may be of different shapes, such as, for example, a convexo-convex body with two concave horizontal surfaces.

1 Claim, 5 Drawing Sheets

GRATINGS FOR WINDOWS/DOORS

BACKGROUND OF THE INVENTION

Conventional steel or stainless steel gratings for windows/doors as shown in FIG. 1 usually consists of a plurality of crossed steel or stainless steel strips. Such strips are first twisted at predetermined points and are then joined by drilling a small hole at desired intersection to allow a rivet to pass therethrough and fastens the intersected strips together. To twist and drill the strips, marks for this purpose are required. The strips are twisted so that they are turned 90 degrees between two holes. To rivet together the strips, hammer and anvil as well as other tools are possibly required to help the riveting. Therefore, the fabrication and manufacture of conventional steel or stainless steel gratings for windows/doors as shown in FIG. 1 is laborious and time-consuming. Moreover, the strips are not twisted and drilled so precisely that the fabricated strips may not be fitly and successfully riveted together through the holes drilled.

FIG. 2 illustrates another type of conventional stainless steel gratings for windows/doors, in which stainless steel flat strips for horizontal members and round bars for vertical members are combined. Small holes have to be drilled on the flat strips for the round bars to fitly pass through. Again, any deviation in position of the drilled holes or any crook of the strips will easily hinder the successful engagement of the round bars with the flat strips through the holes. The manufacture and assembly of such Gratings is inconvenient (time-consuming and labor-consuming). Moreover, the drilled flat strips shall have narrowed margins and accordingly, reduced strength and are easily broken from outcoming forces. The assembled flat strips and round bars tend to loosen at the joints. The appearance of such conventional gratings for windows/doors are monotonous which decreases the utility of the windows/doors. Therefore, it is desirable to develop gratings for windows/doors consisting of integrally formed and durable members that can be easily assembled and can give the windows/doors changeful appearance.

SUMMARY OF THE INVENTION

A primary object of the present invention is to provide gratings for windows/doors which are formed from a plurality of integrally formed members which can be easily and firmly assembled. The members of the gratings for windows/doors according to the present invention are divided into top members having lower notches or cuts and bottom members having upper notches or cuts. The top members and the bottom members may be easily assembled by engaging the lower notches of the top members with the upper notches of the bottom members.

Another object of the present invention is to provide gratings for windows/doors which are simple in structure, easy in manufacture, and changeful in appearance.

BRIEF DESCRIPTION OF THE DRAWINGS

The features and functions of the present invention can be best understood by referring to the following detailed description of the preferred embodiment and the accompanying drawings wherein.

DETAILED DESCRIPTION OF THE PREFERRED EMBODIMENTS

Figure 1:
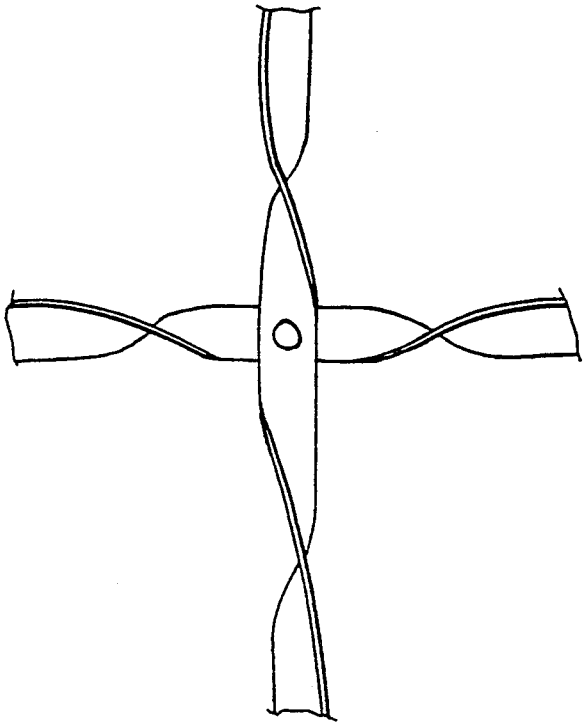
FIG 1 PRIOR ART
FIG. 1 is a fragmentary View showing the structure of one type of conventional steel or stainless steel gratings for windows/doors.
Figure 2:
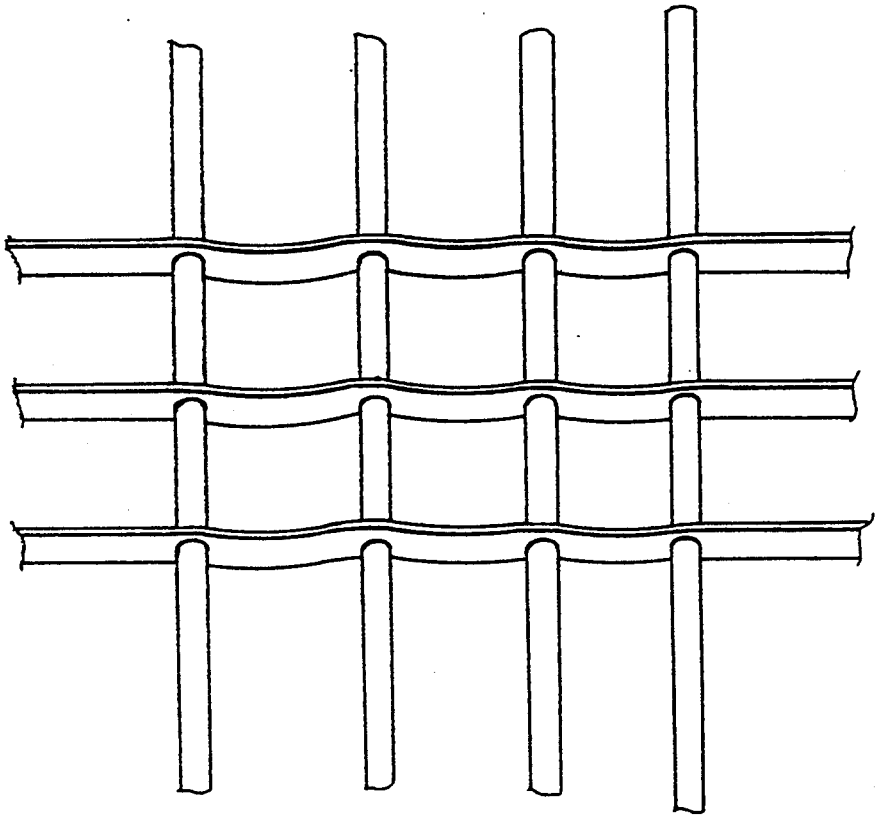
FIG 2 PRIOR ART
FIG. 2 is a fragmentary view showing another type of structure of conventional steel or stainless steel gratings for windows/doors.
Figure 3:
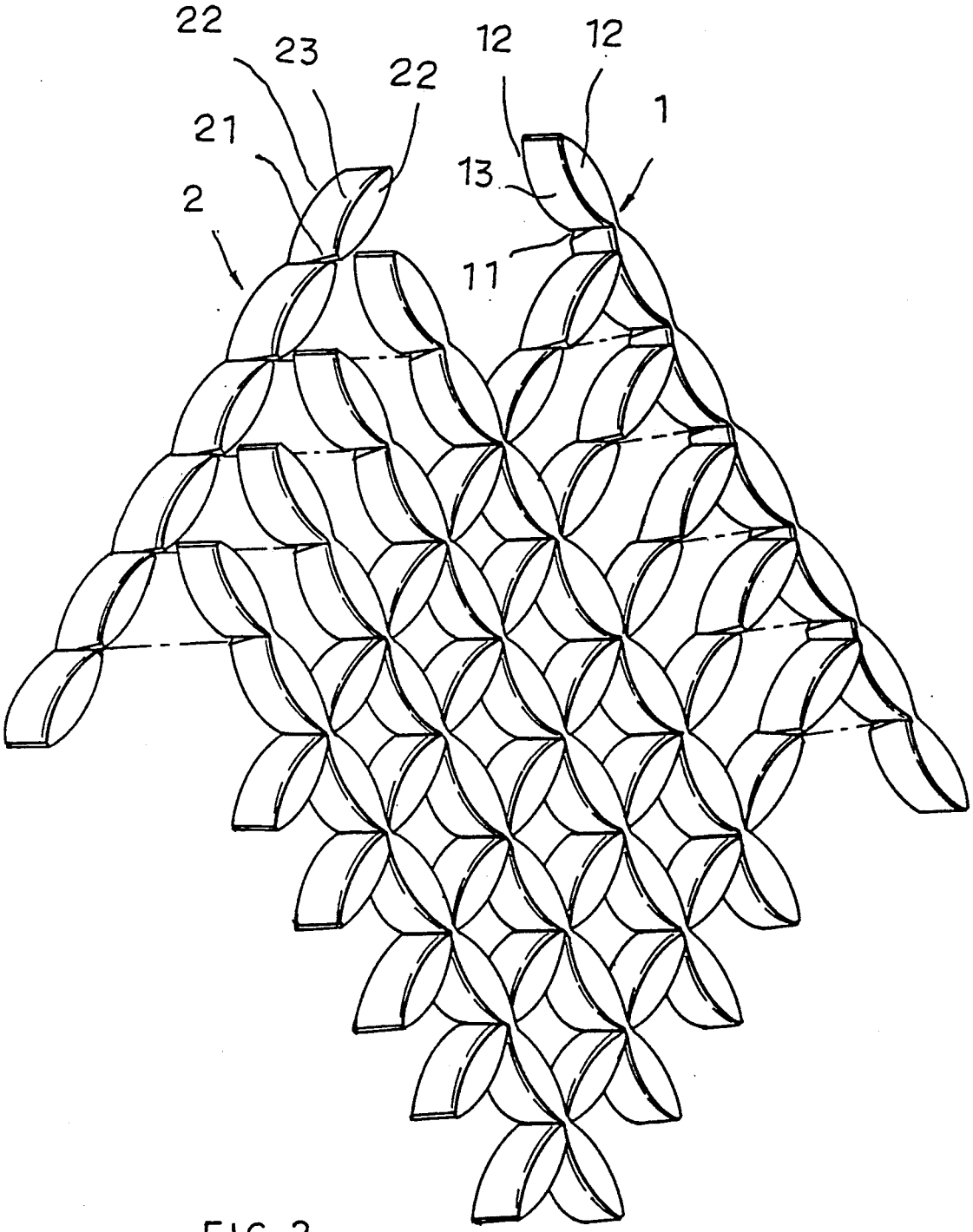
FIG. 3 is a fragmentary, disassembled three-dimensional perspective of the window/door gratings according to the present invention.

Please refer to FIG. 3, an embodiment of window/door gratings according to the present invention is formed from a plurality of integrally formed top members 1 and bottom members 2. The top members 1 each has, at a lower side thereof, a plurality of spaced lower notches or cuts 11 which each has a depth equal to one half of the thickness of the top member 1. The bottom members 2 each has, at an upper side thereof, a plurality of spaced upper notches or cuts 21 which each has a depth equal to one half of the thickness of the bottom member 2. The top member 1 and the bottom member 2 have similar dimensions and shape except the notches or cuts at different positions.

Figure 4:
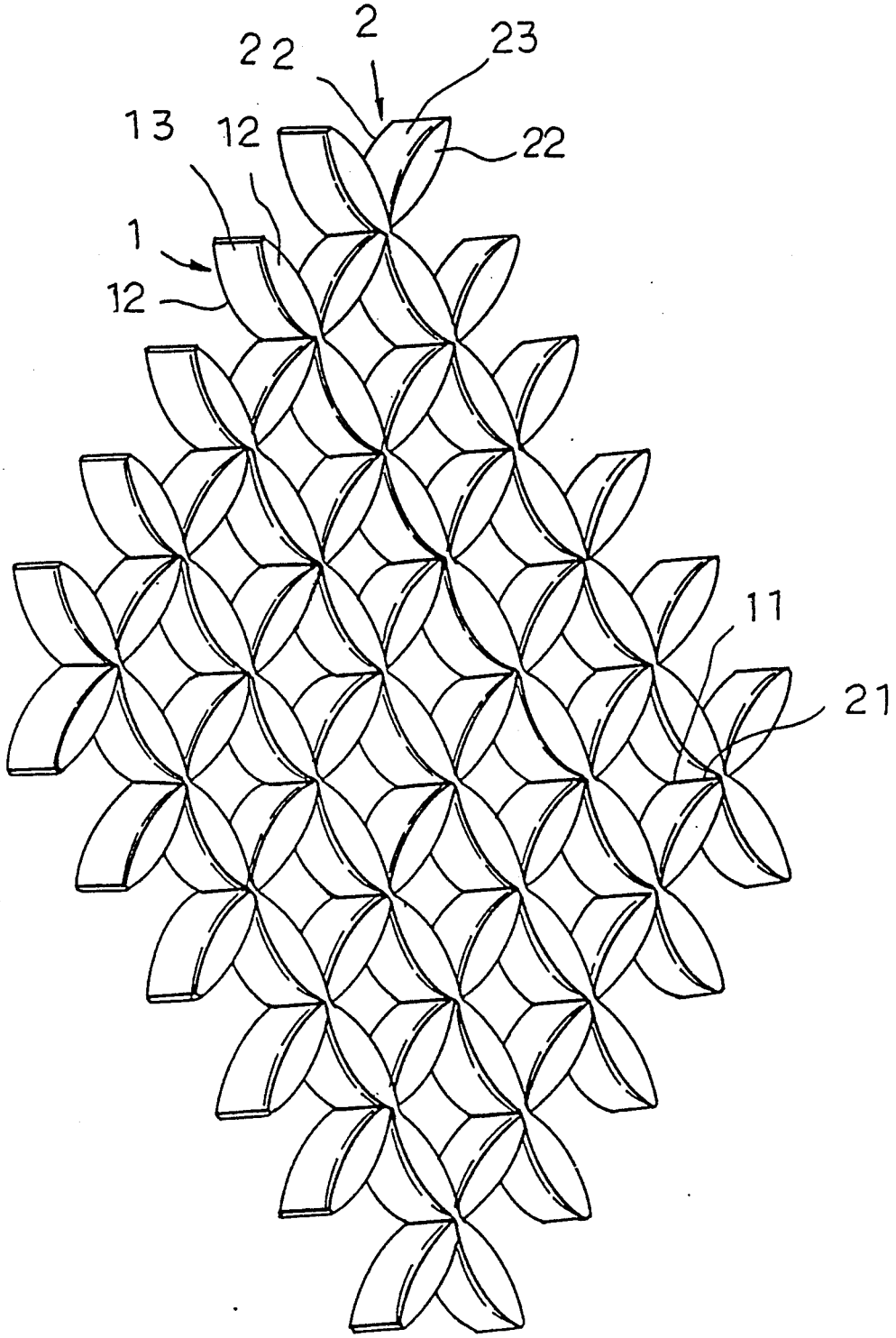
FIG. 4 is a fragmentary, assembled three-dimensional perspective of the window/door gratings of the present invention.

Please further refer to FIG. 4. In assembling the top members 1 and the bottom members 2, engage the lower notches or cuts 11 of the top members 1 with the upper notches or cuts 21 Of the bottom members 2 such that the assembled top members 1 and bottom members 2 form a substantially checked pattern. Since the depth of the upper and the lower notches or cuts 11, 21 is the same and equal to one half of the thickness of the members 1, 2, the assembled top members 1 and bottom members 2 provide a considerably firm and strong structure that has a thickness (depth) exactly the same as that of the top and/or the bottom members.

Figure 5A:
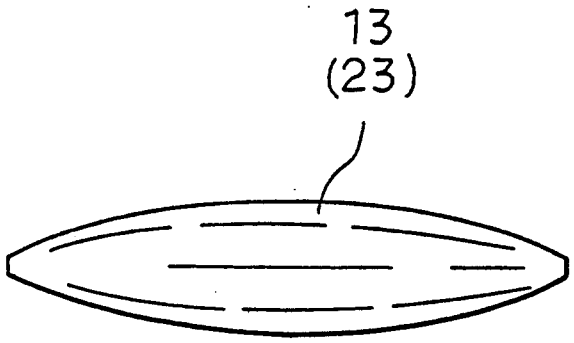
FIGS. 5A and 5B show the top view and the front view, respectively, of the section of the members between two notches or cuts.
Figure 5:
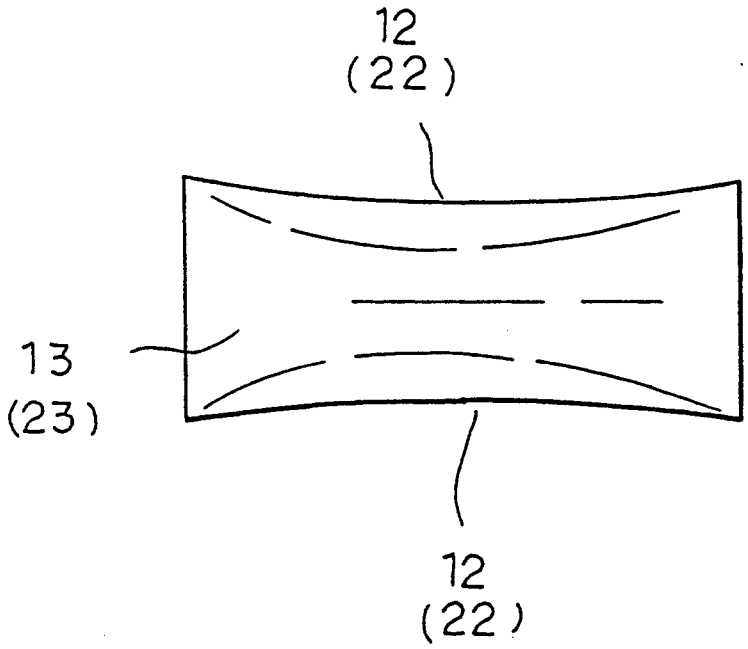

Please now refer to FIG. 5. Each section 13, 23 of the top and the bottom members 1, 2 between two notches or cuts 11, 21, respectively, may be designed to have different shapes. In the embodiment as shown in FIG. 5, The sections 13, 23 are convexo-convex but have two concave horizontal surfaces 12, 22. Also, the bottom notches or cuts 11 and the upper notches or cuts 21 may be so designed that they enable the top members 1 and the bottom members 2 to intersect with one another at different angles to show different patterns. To strengthen the connection of two notches or cuts 11, 21, the intersections of the top and the bottom members may be slightly welded.

The advantages of the present invention are:

1. the members are integrally formed and therefore, have uniform dimensions;
2. the members can be easily and quickly assembled;
3. the assembled members provide considerably firm, strong and durable structure;
4. the structure thereof is simple;
5. the manufacture of the present invention is easy and the manufacturing cost is low;
6. changeful and beautiful appearances are available through different inclination of the members;

7. the invention can be used in diverse forms, such as to serve as a flower stand, in addition to be used with windows and/or doors; and 8. the invention is practical and economical in use.

What is claimed is:

1. Gratings for windows/doors comprising a plurality of top members which each as a plurality of lower notches or cuts formed only at lower side of said top members, and a plurality of bottom members which each has a plurality of upper notches or cuts formed only at upper side of said bottom members; each notch of said plurality of lower notches having a depth equal to one half a depth of said top members, each notch of said plurality of upper notches having a depth equal to one half a depth of said bottom members, said top members and said bottom members being assembled by engaging said lower notches or cuts of said top members with said upper notches or cuts of said bottom members so that said top members intersect with said bottom members at each engaged notch or cut; said top members and said bottom members having sections with opposing convex side walls, a concave upper wall and a concave lower wall between adjacent notches or cuts of said lower notches and said upper notches, said convex side walls having end edges adjacent said notches or cuts, wherein a full end edge of said end edges of said opposing convex side walls of said top members are engaged to a full end edge of said end edges of said opposing convex side walls of said bottom members when said bottom members are assembled.

* * * * *